US007241108B2

(12) United States Patent
Lewis

(10) Patent No.: US 7,241,108 B2
(45) Date of Patent: Jul. 10, 2007

(54) CANTILEVERED STATOR STAGE

(75) Inventor: Leo V Lewis, Kenilworth (GB)

(73) Assignee: Rolls-Royce plc, London (GB)

( * ) Notice: Subject to any disclaimer, the term of this patent is extended or adjusted under 35 U.S.C. 154(b) by 124 days.

(21) Appl. No.: 11/025,119

(22) Filed: Dec. 30, 2004

(65) Prior Publication Data

US 2005/0152778 A1 Jul. 14, 2005

(30) Foreign Application Priority Data

Jan. 13, 2004 (GB) ..... 0400752.2

(51) Int. Cl.
*F01D 11/12* (2006.01)

(52) U.S. Cl. ..... 415/173.4; 415/174.4

(58) Field of Classification Search ..... 415/173.3, 415/173.4, 173.6, 174.2, 174.3, 174.4, 229, 415/230
See application file for complete search history.

(56) References Cited

U.S. PATENT DOCUMENTS 3,346,175 A 10/1967 Wiles
3,617,150 A * 11/1971 Wagle ..... 416/198 R
4,875,831 A * 10/1989 Fetiveau ..... 416/228

FOREIGN PATENT DOCUMENTS

| | | |
|---|---|---|
| EP | 1 392 957 | 3/2002 |
| GB | 0 682 951 | 11/1952 |
| GB | 0 902 645 | 8/1962 |

* cited by examiner

*Primary Examiner*—Edward K. Look
*Assistant Examiner*—Dwayne J White
(74) *Attorney, Agent, or Firm*—W. Warren Taltavull; Manelli Denison & Selter PLLC

(57) ABSTRACT

A cantilevered stator stage for the axial compressor 14 of a gas turbine engine 10 in which the stator tips 26 rub against an abrasive section 24 on the rotor drum 22 during initial running of the engine 10 to abrade the tips 26 of the stator to provide optimised stator tip running clearance.

10 Claims, 3 Drawing Sheets

CANTILEVERED STATOR STAGE

FIELD OF THE INVENTION

This invention relates to cantilevered stator stages, and axial compressors and turbines including such stages for gas turbine engines. The invention also relates to a method of building an axial compressor or turbine for a gas turbine engine and also a method of optimising cantilever stator tip clearance in such an axial compressor or turbine.

BACKGROUND OF THE INVENTION

In gas turbine engines it is generally desirable for efficient operation to maintain minimum rotor tip clearances, and preferably with a substantially constant clearance around the circumference. This is the position for instance with cantilevered stators in an axial compressor or turbine. This can be difficult to achieve due for instance to various asymmetric effects either on build or during running. These effects include the casing centre being offset relative to the rotor drum centre line during build and/or during running. The casing may be distorted from a circular shape during build and/or running, and for instance the casing may become ovalised.

SUMMARY OF THE INVENTION

According to the present invention there is provided a cantilevered stator stage for a gas turbine engine, the stage comprising a plurality of stators circumferentially arranged around a rotor drum, with an abrasive section provided on the rotor drum facing the stators, the stage being arranged such that during initial running of the engine at least most of the stators rub against the abrasive section, to abrade the tips of the stators.

The cantilevered stator stage may be for an axial compressor or a turbine of a gas turbine engine.

The stage may be arranged such that during initial running of the engine all of the stator tips rub against the abrasive section.

The abrasive section may comprise an abrasive coating such as alumina on the rotor drum. Alternatively, the abrasive section may comprise an area of hardened rotor drum material.

The tips of the stators may be formed so as to facilitate abrasion thereof. The stators may have a reduced thickness towards the tips thereof, and the reduced thickness may be provided by tapering or a stepped profile.

The invention also provides a compressor for a gas turbine engine, the compressor comprising a plurality of stator stages according to any of the preceding five paragraphs.

The invention further provides an axial turbine for a gas turbine engine, the turbine comprising a plurality of stator stages according to any of said preceding five paragraphs.

According to another aspect of the invention there is provided a method of building a cantilevered stator stage for a gas turbine engine, the method comprising providing a plurality of stators circumferentially arranged around a rotor drum, providing an abrasive section on the rotor drum facing the stators, arranging the stator lengths such that during initial running of the engine at least most of the stators rub against the abrasive section, to abrade the tips of the stators.

The cantilevered stator stage may be for an axial compressor or a turbine of a gas turbine engine.

The stator lengths may be arranged such that all of the stator tips rub against the abrasive section during initial running.

The stator tips may be machined circular or offset relative to the rotor.

The stator tips may be built concentric or offset relative to the rotor.

The invention further provides a method of building an axial compressor for a gas turbine engine, the method including building a plurality of stator stages according to any of the above five paragraphs.

The invention also provides a method of building a turbine for a gas turbine engine, the method including building a plurality of stator stages according to any of said above five paragraphs.

The invention yet further provides a method of optimising tip clearance in the axial compressor or turbine of a gas turbine engine, the method being according to any of the preceding seven paragraphs.

BRIEF DESCRIPTION OF THE DRAWINGS

An embodiment of the present invention will now be described by way of example only and with reference to the accompanying drawings, in which:

FIGS. 7 to 9 are diagrammatic axial section views respectively of a compressor according to the invention, following building and whilst cold; during running in; and following running in.

DETAILED DESCRIPTION OF THE INVENTION

Figure 1:
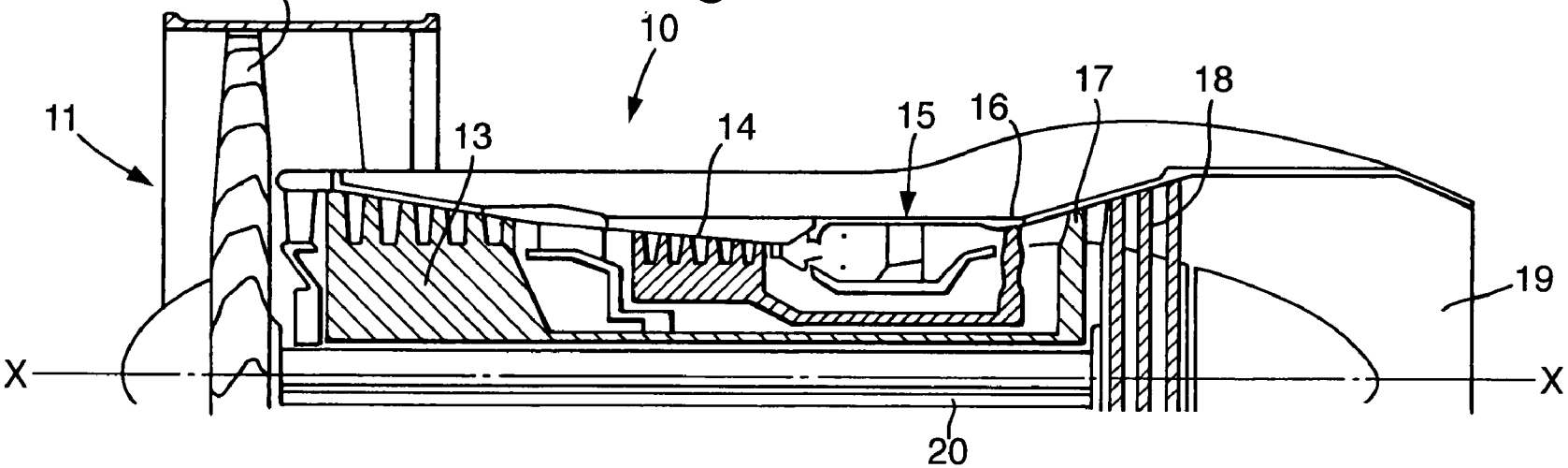
FIG. 1 is a sectional side view of the upper half of a gas turbine engine.

Referring to FIG. 1, a gas turbine engine is generally indicated at 10 and comprises, in axial flow series, an air intake 11, a propulsive fan 12, an intermediate pressure compressor 13, a high pressure compressor 14, combustion equipment 15, a high pressure turbine 16, an intermediate pressure turbine 17, a low pressure turbine 18 and an exhaust nozzle 19.

The gas turbine engine 10 works in a conventional manner so that air entering the intake 11 is accelerated by the fan 12 which produces two air flows: a first air flow into the intermediate pressure compressor 13 and a second air flow which provides propulsive thrust. The intermediate pressure compressor compresses the air flow directed into it before delivering that air to the high pressure compressor 14 where further compression takes place.

The compressed air exhausted from the high pressure compressor 14 is directed into the combustion equipment 15 where it is mixed with fuel and the mixture combusted. The resultant hot combustion products then expand through, and thereby drive, the high, intermediate and low pressure turbines 16, 17 and 18 before being exhausted through the nozzle 19 to provide additional propulsive thrust. The high, intermediate and low pressure turbine 16, 17 and 18 respectively drive the high and intermediate pressure compressors 14 and 13, and the fan 12 by suitable interconnecting shafts.

Figure 2:
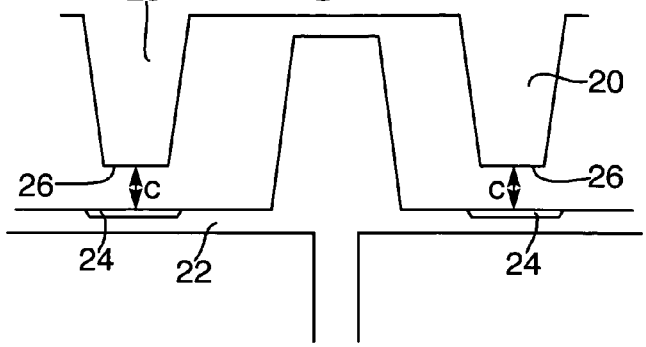
FIG. 2 is a diagrammatic sectional view of part of a compressor incorporated in the engine shown in FIG. 1.

FIG. 2 shows part of the high pressure compressor 14 with two cantilevered stators 20 facing the rotor assembly 22. The parts of the assembly 22 which face the stators 20 have an inlaid abrasive section 24. The section 24 may be provided by an abrasive coating such as alumina in a recess of the rotor assembly material. Alternatively, an area of hardened rotor assembly material may be provided, which may have been hardened by flame treatment and/or the addition of carbon.

FIG. 2 is diagrammatic and the clearance C between the stator tips 26 and the sections 24 is shown significantly larger than is the actual case. In use the stators 20 are made such that during initial running of the engine 10, most if not all of the stator tips 26 rub against the sections 24 and are abraded thereby.

Figure 3:
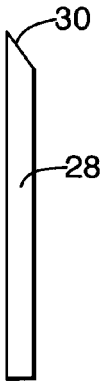
FIG. 3 is a cross sectional view through a component of the compressor of FIG. 2 following building.
Figure 4:
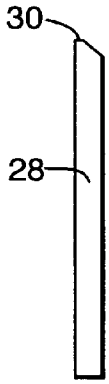
FIG. 4 is a similar view to FIG. 3 but of the component following initial running.
Figure 5:
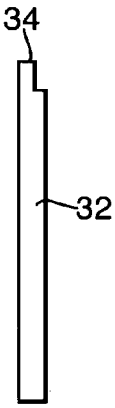
FIG. 5 is a similar view to FIG. 3 but of an alternative component.
Figure 6:
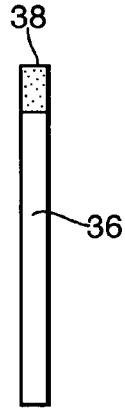
FIG. 6 is a similar view to FIG. 3 but of a further alternative component.

The tips 26 of the stators 20 may be formed so as to facilitate abrasion thereof. FIG. 3 shows a stator 28 with a chamfered tip 30 such that during abrasion thereof only a small thickness of material is removed. FIG. 4 shows the stator 28 following running of the engine 10 with the tip 30 having been blunted. FIG. 5 shows an alternative stator 32 which has a stepped tip 34, again such that during abrasion only a small amount of material will be removed. FIG. 6 shows a stator 36 where the tip area 38 is formed of a softer material than the remainder of the stator 36.

The compressor 14 is fabricated such that during initial running most if not all of the stators 20 will rub against the abrasive section 24, and the build clearances are therefore chosen accordingly. The stator tips 26 would be machined circular or offset, and may be built concentric or offset relative to the rotor.

Figure 7:
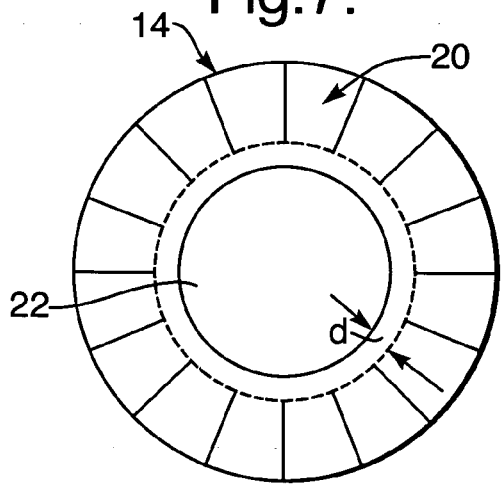
Figure 8:
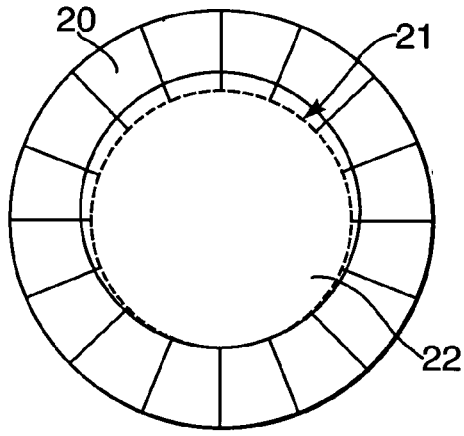
Figure 9:
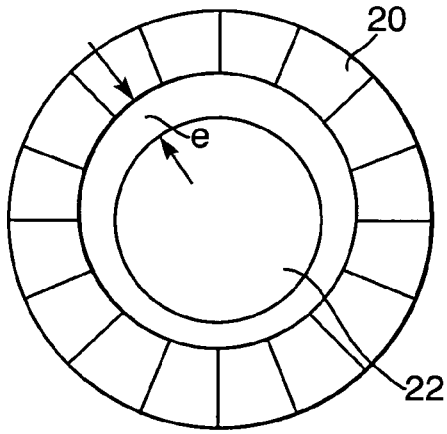

FIG. 7 shows diagrammatically the compressor 14 following building and whilst cold. There is a cold build clearance d between the stators 20 and the rotor assembly 22. During running in (FIG. 8) inter alia centrifugal growth and thermal expansion causes the assembly 22 to rub against the stators 20 e.g. at 21 causing the latter to abrade. FIG. 9 shows the situation following running in with an enlarged cold build clearance e, with a profile such that during further running the assembly 22 substantially does not rub against the stators 20, and a minimum clearance is provided therebetween.

The above described arrangement provides for significant advantages. For instance, an optimised stator tip running clearance is provided for a given casing asymmetry. All engines of a given engine type will have the same post run-in strip clearance irrespective of their build tolerance. The not insignificant expense of offset machining can be avoided. An exact knowledge of the casing asymmetry will not be required. There should be no drum wear and hence change in balance of the engine.

Whilst the above invention has been described in terms of cantilever stators for a compressor, the invention is also applicable to cantilevered stators in a turbine. Various other modifications may be made without departing from the scope of the invention. For instance, other abrasive sections could be used. The stators could be provided with a different cross section.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. A cantilevered stator stage for a gas turbine engine, the stage comprising a plurality of stators circumferentially arranged around a rotor drum, with an abrasive section provided on the rotor drum facing the stators, the stage being arranged such that during initial running of the engine at least most of the stators rub against the abrasive section, to abrade the tips of the stators in which the tips of the stators are formed so as to facilitate abrasion thereof in which the stators have a reduced thickness towards the tips thereof.

2. A method of building a cantilevered stator stage for a gas turbine engine, the method comprising providing a plurality of stators circumferentially arranged around a rotor drum, providing an abrasive section on the rotor drum facing the stators, arranging the stator lengths such that during initial running of the engine at least most of the stators rub against the abrasive section, to abrade the tips of the stators.

3. A method according to claim 2 wherein the abrasive section comprises an abrasive coating.

4. A method according to claim 2 wherein the abrasive section comprises an area of hardened rotor drum material.

5. A method according to claim 2 wherein the tips of the stators are formed so as to facilitate abrasion thereof.

6. A method according to claim 2, in which the cantilevered stator stage is for an axial compressor of a gas turbine engine.

7. A method of building an axial compressor for a gas turbine engine, the method including building a plurality of stator stages according to claim 6.

8. A method according to claim 2, in which the cantilevered stator stage is for a turbine of a gas turbine engine.

9. A method of building a turbine for a gas turbine engine, the method including building a plurality of stator stages according to claim 8.

10. A method according to claim 2, in which the stator lengths are arranged such that all of the stator tips rub against the abrasive section during initial running.

* * * * *